US009570842B2

(12) United States Patent
Nordgren et al.

(10) Patent No.: US 9,570,842 B2
(45) Date of Patent: Feb. 14, 2017

(54) MAGNETIC DIAGNOSTIC PROBE CONNECTOR SYSTEM

(75) Inventors: Timothy F. Nordgren, Bothell, WA (US); Tracy C. Brechbiel, Lake Stevens, WA (US); John Douglas Fraser, Woodinville, WA (US)

(73) Assignee: Koninklijke Philips N.V., Eindhoven (NL)

( * ) Notice: Subject to any disclaimer, the term of this patent is extended or adjusted under 35 U.S.C. 154(b) by 799 days.

(21) Appl. No.: 13/390,206

(22) PCT Filed: Aug. 3, 2010

(86) PCT No.: PCT/IB2010/053523

§ 371 (c)(1),
(2), (4) Date: Feb. 13, 2012

(87) PCT Pub. No.: WO2011/024091

PCT Pub. Date: Mar. 3, 2011

(65) Prior Publication Data

US 2012/0143062 A1 Jun. 7, 2012

Related U.S. Application Data

(60) Provisional application No. 61/238,419, filed on Aug. 31, 2009.

(51) Int. Cl.
*H01R 13/62* (2006.01)
*H01R 13/645* (2006.01)

(52) U.S. Cl.
CPC ..... *H01R 13/6205* (2013.01); *H01R 13/6456* (2013.01); *H01R 2201/12* (2013.01)

(58) Field of Classification Search
CPC ..... A61B 8/00; H01R 13/6205
USPC ..... 600/407, 437, 459; 439/38–40
See application file for complete search history.

(56) References Cited

U.S. PATENT DOCUMENTS

| | | | | |
|---|---|---|---|---|
| 6,561,815 | B1 | 5/2003 | Schmidt | |
| 7,329,128 | B1 | 2/2008 | Awad | |
| 2007/0254510 | A1 | 11/2007 | DeBey | |
| 2010/0160786 | A1* | 6/2010 | Nordgren et al. | 600/459 |

FOREIGN PATENT DOCUMENTS

| | | | |
|---|---|---|---|
| CA | 2320682 | A1 | 9/2000 |
| DE | 2516011 | A1 | 10/1976 |
| EP | 1596461 | A1 | 11/2005 |
| JP | 509990 | | 1/1975 |
| JP | 11144803 | A | 5/1999 |
| JP | 2003504815 | A | 2/2003 |
| NL | 107887 | A | 3/1964 |
| WO | 2008146205 | A1 | 12/2008 |

* cited by examiner

*Primary Examiner* — Peter Luong

(57) ABSTRACT

A magnetic connection system suitable for use with a wireless ultrasound probe which utilizes a plurality of magnets to facilitate coupling between said probe and a diagnostic or clinical device in a manner which minimizes the effects of stray magnetic fields on the device.

13 Claims, 2 Drawing Sheets

MAGNETIC DIAGNOSTIC PROBE CONNECTOR SYSTEM

This application is a continuation in part of U.S. Ser. No. 60/941,427, filed on Jun. 1, 2007.

This invention relates to medical diagnostic systems, for example ultrasound systems and, in particular, to magnetic connector systems for coupling such systems to removable probes.

BACKGROUND OF THE INVENTION

One of the long-time disadvantages of medical diagnostic ultrasound, particularly for sonographers, is the cable that connects the scanning probe to the ultrasound system. These cables are long and often thick due to the need to contain many coaxial lines from the dozens, hundreds, or even thousands of transducer elements in the probe. As a consequence, these probe cables can be cumbersome to deal with and can be heavy. Some sonographers try to deal with the cable problem by draping the cable over an arm or shoulder for support while scanning. This can lead to repetitive stress injuries in many cases. Another problem is that the probe cable can contaminate the sterile field of an image-guided surgical procedure. Furthermore, these probe cables are rather expensive, often being the most expensive component of the probe. Thus, there is a long-felt desire to rid diagnostic ultrasound of probe cables.

U.S. Pat. No. 6,142,946 (Hwang et al.) describes an ultrasound probe and system which do just that. This patent describes a battery-powered array transducer probe with an integral beamformer. A transceiver sends acquired ultrasound data to an ultrasound system serving as its base station. Image processing and display is done on the ultrasound system.

While a wireless ultrasound probe frees the user of the inconvenience of a cable, there are situations where a cable may be needed or desired for a wireless probe. For example, a cable could be used to recharge the battery in the probe. If the battery runs low during a scanning procedure, a cable could provide the means to power the wireless probe while the procedure is completed. In other instances a user may prefer to have a probe tethered to the ultrasound system for various reasons. A cable may enable a procedure to proceed when the wireless link does not seem to be operating properly. Accordingly it is desirable to have a cable for performing these functions should these situations or circumstances arise.

Published Patent Application WO 2008/146205 A1 (U.S. Ser. No. 60/941,427 (the '427 application)), the teachings of which are incorporated by reference herein, describes a wireless ultrasound probe which is selectively coupled to a host system by a cable. The host system can be used solely to power the wireless probe or recharge the battery of the probe. The host system can also be the system which processes or displays the image data produced by the wireless probe and the cable can be used to provide the image data to the host system by wire in the event of difficulties with the wireless data link.

In an example described in the '427 application, a wireless probe is selectively coupled to the host system cable using a magnetic, hermetically sealed connector system. This connector system provides for a break-away "quick connect-disconnect" connection between the probe and the host system cable.

SUMMARY OF THE INVENTION

The present invention comprises improvements to the magnetic connector system which improves the strength of the coupling of the host system cable to the probe and one which, among other things, reduces the effect of stray magnetic fields.

Preferred embodiments of this invention use a connector system comprising a set of magnets arranged to form one or more quadrupoles. The quadrupole arrangement increases the rate at which the magnetic field strength drops off with respect to distance so that a medically safe value is achieved at distances relevant to the specific application or procedure.

DETAILED DESCRIPTION OF THE INVENTION

Figure 1:
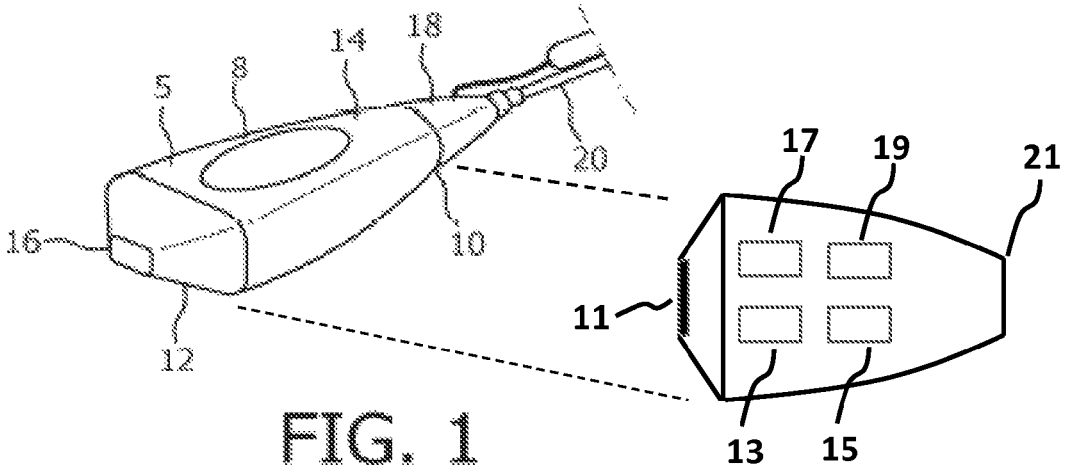
FIG. 1 illustrates a handheld wireless ultrasound probe coupled to a host system cable by a connection system comprising a preferred embodiment of the present invention.

Referring first to FIG. 1, a wireless ultrasound probe 5 is shown coupled to host system cable 20 using an embodiment of the magnetic connection system comprising the invention 10. The probe 5 is enclosed in a hard polymeric enclosure or case 8 which has a distal end 12 and a proximal end 14. The transducer lens or acoustic window 16 for the array transducer is at the distal end 12. It is through this acoustic window that ultrasound waves are transmitted by the transducer array and returning echo signals are received. An antenna is located inside the case 8 at the proximal end 14 of the probe which transmits and receives radio waves to and from a base station host. The wireless probe contains a rechargeable battery to provide power. The wireless probe includes an array transducer 11, an acquisition circuit 13, a transceiver 15, a power circuit 17, an energy storage device 19, and a cable connector 21.

While the major advantage of a wireless probe is the ability to use the probe without it being mechanically attached to the system host cable 20, there are situations in which coupling the probe 12 to the system host cable 20 is desirable. The system host cable 20 for example, can provide power which, when coupled to the probe 12, can recharge the probe. In other situations, if a sonographer is conducting an ultrasound exam and the beeper sounds to indicate a low battery condition, the sonographer may want to continue using the probe to conduct the exam and may want to switch from battery power to cable power. In that situation coupling to power cable would be desirable while the battery recharges.

Whether the probe is coupled or decoupled from the system host cable however, when a magnetic connection system is used to provide the coupling, the effect of stray magnetic fields must be minimized. The present invention provides a way to minimize the effects of stray magnetic fields from the portions of the magnetic connection system, whether the probe is in the coupled or decoupled position. It also comprises, but is not limited to, the use of the improved connection system as part of, and in conjunction with the diagnostic systems disclosed in the '427 application which is incorporated by reference herein.

An even number of magnets oriented with poles in opposed directions maximizes the rate at which the magnetic field strength drops off at distances relevant to medical applications. An odd number of dipole magnets (1, 5, etc.) cannot be optimized in this way. The magnetic field strength of a single magnetic dipole for example, drops off as the inverse of the square of the distance. In contrast to this, the field strength of a quadrupole magnetic field drops off as the inverse of the cube of the distance in the relative far-field. As described by Wikipedia, http://en.wikipedia.org/wiki/Quadrupole magnet): " . . . The simplest magnetic quadrupole is two identical bar magnets parallel to each other such that the north pole of one is next to the south of the other and vice versa. Such a configuration would have no dipole moment, and its field will decrease at large distances faster than that of a dipole."

Minimizing the magnetic field strength is important when using an ultrasound transducer in the vicinity of an implantable device such as a pacemaker or a drug delivery system which can be sensitive to magnetic fields. Instead of using one magnet disposed within the proximal end of the probe which is magnetically coupled to the ferrous material of a connector connected to the end of the host system cable, as described in the '427 application, the present invention utilizes at least one two magnets each disposed upon opposite portions of the magnetic connection system so as to form at least one quadrupole.

Figure 2:
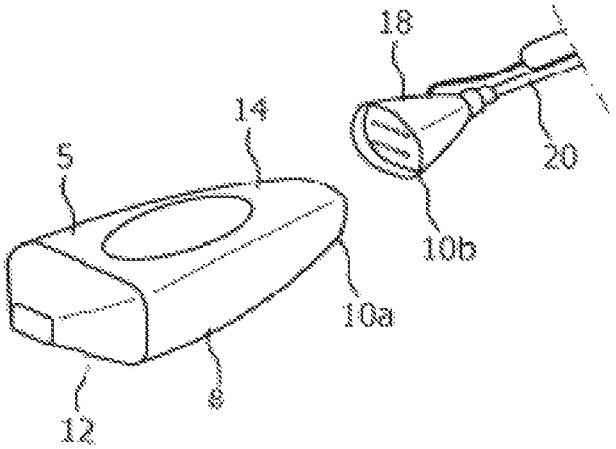
FIG. 2 illustrates the wireless ultrasound probe shown in FIG. 1 with the connection system in the decoupled position.

FIG. 2 illustrates the wireless probe 5 decoupled from the system host cable 20 and further indicates the two portions of connection system 10.

A first connector portion 10*a* is located in the proximal end 14 of probe 5. As shown in more detail in FIG. 4, connector portion 10*a* presents a substantially flat face 30 which is substantially perpendicular to the longitudinal axis of the probe 5.

Figure 3:
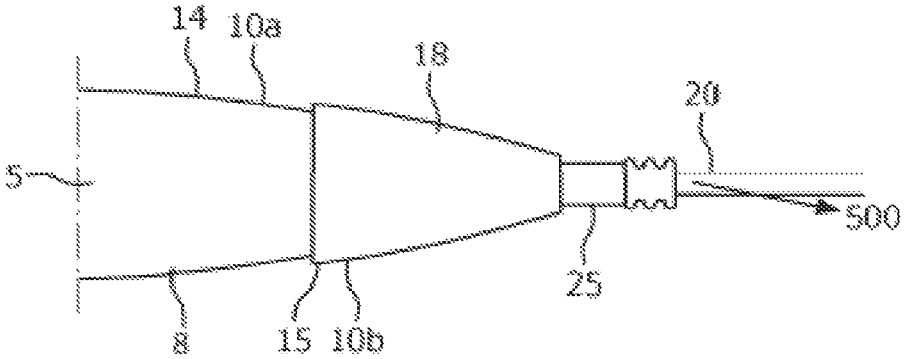
FIG. 3 is another view of the probe shown in FIGS. 1-2 in the coupled position.

A second connector portion 10*b* is located at the end 18 of host system cable 20. As shown in more detail in FIG. 4, connector portion 10*b* presents a substantially flat face 40 which is substantially perpendicular to the longitudinal axis of the rest of connector portion and designed to mate comfortably with portion 10*a* as shown in FIG. 3.

As discussed in the '427 application, various types of host system cables and connectors can be used to selectively couple a wireless probe to the host system, for example a multi-conductor USB cable connector at one end for connection to the host system and a magnetic connector system on the other end for connecting the cable to the probe. Such a cable is described in the '427 patent.

Figure 4:
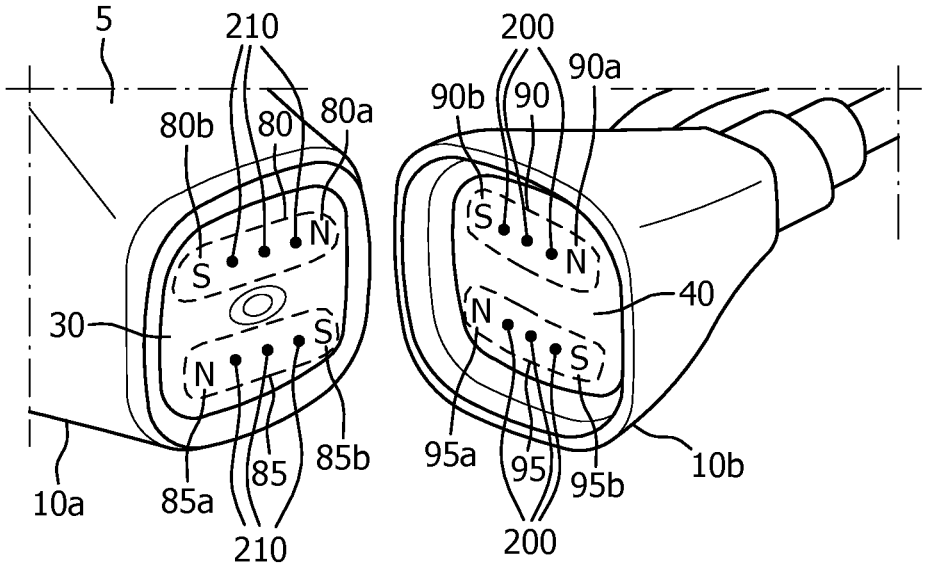
FIG. 4 illustrates the two connector portions comprising the connection system of the embodiment of the invention shown in FIGS. 1-3.

In the embodiment shown in FIG. 4, a set of four magnets are used. Two magnets, 80 and 85, are disposed within portion 10*a* proximate to substantially flat face 30. These are shown in broken lines to note that they are mounted, in this example, within portion 10*a*. The magnets 80 and 85 are placed parallel to each other with their respective poles arranged in a South-North, North-South configuration. Two other magnets 90 and 95 are disposed within portion 10*b* and proximate to flat face 40 and are also shown in broken lines to indicate that in this example, they are mounted within portion 10*b*. They are also placed parallel to each other with their respective poles arranged in a South-North, North-South configuration.

The pair of magnets, 80 and 85, are arranged so that each of the poles is proximate to a corner of the flat face 30. The pair of magnets, 90 and 95, are similarly arranged with respect to flat face 40. Connection portion 10*b* has an extending lip 15 projecting from its surface and extending around flat face 40. The lip 15 is designed to fit around the surface of portion 10*a*, as shown in FIG. 3 when portions 10*a* and 10*b* are connected.

When flat faces 30 and 40 of connection portions 10*a* and 10*b* respectively are placed proximate to one another at a close enough distance (e.g. pressed near or against each other), the poles of the four magnets 80, 85, 90 and 95 will react to join connection portions 10*a* and 10*b* together to form a secure but detachable connection between one or more contact gold plated "pogo" pins 200 which extend beyond the flat surface 40 and are positioned to meet with corresponding recessed flush mounted gold plated contact pads 210. Although the example shown in FIG. 4, utilizes gold-plated pogo pins 200 and contact pads 210 as contact means, the invention comprises the use of any type of matched contact means suitable for use with the magnetic connection system, for example spring loaded, flat, fiber optic or very short range radio connections.

A quadrupole relationship exists between positioned magnets 80 and 85 of portion 10*a*. Another quadrupole relationship exists between magnets 90 and 95 of portion 10*b*. The quadrupoles on each portion minimize the magnetic field strength coming from each portion when they are not coupled together.

Figure 5:
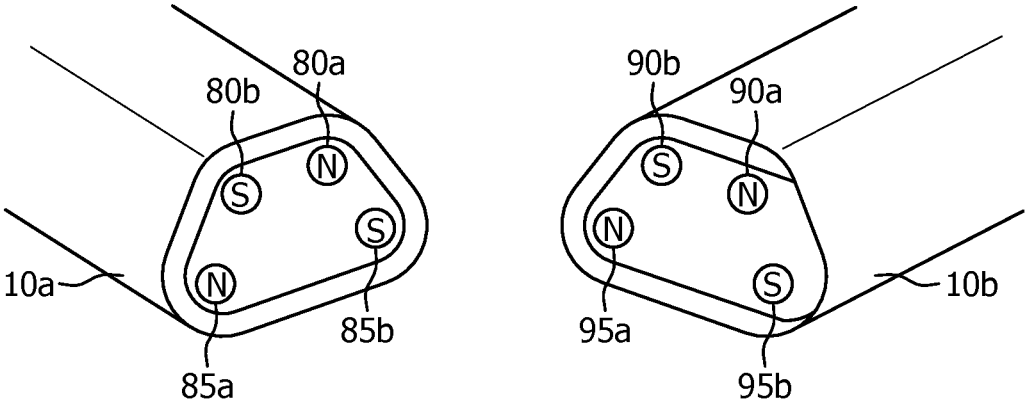
FIG. 5 illustrates another embodiment of the connection system of the embodiment of the invention shown in FIG. 4.

When portions 10*a* and 10*b* are positioned facing each other as shown in FIG. 5 North poles 80*a*,85*a*,90*a* and 95*a* are attracted to South poles 90*b*,95*b*,85*b* and 85*b* respectively. This configuration of magnets, along with a closely fitted and tapered lip 15 as shown in FIG. 3, results in a magnetic connection that couples portion 10*a* to 10*b*. In this coupled position, additional quadrupoles are formed between magnets 80 and 90 and between 85 and 95 thereby providing minimized magnetic field strength coming from the coupled portions.

When four or more magnets are spaced a part at a minimum distance (d) relative to the length (L) of the strain relief (for example lip 15) as shown in FIGS. 4 and 5, the resistance to non-axial side-loads 500 that otherwise would peel-off the magnetic connection increases. Thus the "footing" of the connector portion 10*b* is increased. One or two magnets cannot provide this counter leverage in all directions to oppose the effect of a side-loaded pull on the cable which often occurs in actual use.

Although the embodiment of the invention described above in connection with FIG. 4 provides minimized stray magnetic field strength in the coupled position, because of the symmetrical attraction between the north and south poles, it is possible that the portions can be magnetically coupled in the opposite and incorrect way, e.g. with north poles 80*a*,85*a*,95*a* and 90*a* coupling respectively with south poles 95*b*,90*b*,85*b* and 80*b*. This type of configuration would cause a serious connection problem since the contact points would be reversed and the equipment would not function properly.

One way of preventing this problem would be to orient the poles of magnets 80 and 85 so that the north poles of each magnet are aligned over each other and the south poles are similarly aligned. In other words, magnet 85 would be rotated 180 degrees so that south pole 85*b* is aligned with south pole 80*b*, and similarly magnet 95 would be rotated 180 degrees so that south pole 95*b* is aligned with south pole 90*b*. In this configuration, the portions would have their contact points connected properly when the north and south poles of each magnet were aligned so that they were magnetically attracted. Any attempt to couple the portions incorrectly would result in magnetic repulsion between the poles of magnets 80 and 90 and between the poles of magnets 85 and 95. While this configuration will prevent incorrect connection of the portions 10*a* and 10*b*, quadrupoles would no longer exist in each portion in the decoupled position. A quadrupole relationship between magnets 80 and 90, and 85 and 95 respectively would still exist however when the portions 10*a* and 10*b* are coupled together but the advantage of having a quadrupole in each individual portion and the reduction in stray magnetic interference even when the portions are uncoupled would be lost.

FIG. 5 describes another way to avoid the problem of incorrectly coupling portions 10*a* and 10*b* while still retaining the benefits of the quadrapole relationships shown in FIG. 4.

In FIG. 5, the magnets are shown arranged as described in FIG. 4. In order to prevent incorrect connection of the contacts however (not shown in FIG. 5), the tops of portions 10*a* and 10*b* respectively can be tapered with respect to the bottoms of these portions. In this manner, the portions are "keyed" so that the two portions can only be physically coupled in one way even if the magnetic configuration would permit incorrect coupling. Other keying mechanisms like "tabs" or "notches" etc., could also be used.

The invention claimed is:

1. A magnetic connection system for coupling a diagnostic or therapeutic device to a removable probe, wherein said device has a cable with a first end coupled thereto, and a second end, said connection system comprising:

a first connector portion terminating the second end of said device cable, the first connector portion including a first pair of magnets comprising:

a first magnet including a first set of magnetic poles a first distance apart; and a second magnet including a second set of magnetic poles, the second set of magnetic poles a second distance apart, wherein the second distance is greater than the first distance, wherein the first and second magnets are arranged as a first quadrupole; and a second connector portion positioned within or upon said probe, the second connector portion including a second pair of magnets comprising:

a third magnet including a third set of magnetic poles, the third set of magnetic poles a third distance apart, wherein the third distance is equal to the first distance; and a fourth magnet including a fourth set of magnetic poles, the fourth set of magnetic poles a fourth distance apart, wherein the fourth distance is equal to the second distance, wherein the third and fourth magnets are arranged as a second quadrupole;

wherein the first magnet and the third magnet are arranged such that each magnetic pole of the first and third sets of magnetic poles is aligned with a pole of opposite polarity when the first connector portion is in a first orientation relative to the second connector portion, and wherein the second magnet and the fourth magnet are arranged such that each magnetic pole of the second and fourth sets of magnetic poles is aligned with a pole of opposite polarity only when the first connector portion is in the first orientation relative to the second connector portion.

2. The magnetic connection system of claim 1 wherein at least two of said first and second pairs of magnets are arranged to form at least one additional quadrupole when said first and second connector portions are coupled together.

3. The magnetic connection system of claim 1, wherein said first and second connector portions each comprise at least one contact and wherein said first and second connector portions are magnetically configured to so that said contacts connect only in a predetermined manner.

4. The magnetic connection system of claim 1, wherein said first and second connector portions each comprise at least one contact and wherein said first and second connector portions are physically configured to so that said contacts connect only in a predetermined manner.

5. A wireless ultrasound probe suitable for use with a cable comprising the magnetic connection system of claim 1 and further comprising:

a probe case comprising the first connector portion of said connection system;

an array transducer located in the case;

an acquisition circuit located in the case and coupled to the array transducer;

a transceiver located in the case which acts to wirelessly transmit image information signals to a host system;

a power circuit located in the case which operates to provide energizing voltage to the array transducer, the acquisition circuit, and the transceiver;

an energy storage device located in the case and coupled to the power circuit;

a cable connector coupled to said cable, comprising the second connector portion of said connection.

6. The wireless ultrasound probe of claim 5, wherein the cable conveys an energizing potential for charging the energy storage device.

7. The wireless ultrasound probe of claim 5, wherein the cable conveys image information signals to a host system for display of an ultrasound image.

8. The wireless ultrasound probe of claim 5, wherein the cable conveys control signals from a host system to the wireless probe.

9. The wireless ultrasound probe of claim 5, wherein said first connector portion is located at least partially in the case and is covered by a protective covering.

10. The wireless ultrasound probe of claim 5, wherein said first connector portion further comprises a plurality of contacts and said second connector portion comprises a second plurality of contacts, and wherein said first and second plurality of contacts are adapted to mate respectively when said first connector portion is coupled to said second connector portion.

11. The wireless ultrasound probe of claim 5 wherein at least two of said first and second pairs of magnets are arranged to form at least one additional quadrupole when said first and second connector portions are coupled together.

12. The wireless ultrasound probe of claim 5, wherein said first and second connector portions each comprise at least one contact and wherein said first and second connector portions are magnetically configured to so that said contacts connect only in a predetermined manner.

13. The magnetic connection system of claim 5, wherein said first and second connector portions each comprise at least one contact and wherein said first and second connector portions are physically configured to so that said contacts connect only in a predetermined manner.

* * * * *